US007497425B2

(12) United States Patent
Taguchi et al.

(10) Patent No.: US 7,497,425 B2
(45) Date of Patent: Mar. 3, 2009

(54) SHEET POST-PROCESSING APPARATUS

(75) Inventors: Tetsuya Taguchi, Osaka (JP); Mitsutoshi Takemoto, Osaka (JP); Takeshi Matsuo, Osaka (JP); Masahiko Miyazaki, Osaka (JP); Keisuke Egawa, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 244 days.

(21) Appl. No.: 11/274,480

(22) Filed: Nov. 16, 2005

(65) Prior Publication Data

US 2006/0290044 A1 Dec. 28, 2006

(30) Foreign Application Priority Data

Nov. 30, 2004 (JP) ..... 2004-345149

(51) Int. Cl.
*B65H 37/04* (2006.01)

(52) U.S. Cl. ..... 270/37; 270/32; 270/58.01; 270/58.07; 270/58.08; 270/58.09; 270/58.12

(58) Field of Classification Search ..... 270/32, 270/37, 58.01, 58.07, 58.08, 58.09, 58.12
See application file for complete search history.

(56) References Cited

U.S. PATENT DOCUMENTS 5,435,535 A * 7/1995 Suzuki et al. ..... 270/58.02
6,217,016 B1 * 4/2001 Honmochi et al. ..... 270/37
6,315,288 B1 * 11/2001 Sugishima et al. ..... 271/303
6,339,685 B1 * 1/2002 Okamoto et al. ..... 399/16
6,381,443 B1 * 4/2002 Kawata et al. ..... 399/407

FOREIGN PATENT DOCUMENTS

| | | |
|---|---|---|
| JP | 01-127556 | 5/1989 |
| JP | 02-182495 | 7/1990 |
| JP | 11-263502 | 9/1999 |

* cited by examiner

*Primary Examiner*—Gene Crawford
*Assistant Examiner*—Leslie A Nicholson, III
(74) *Attorney, Agent, or Firm*—Smith, Gambrell & Russell, LLP

(57) ABSTRACT

A sheet post-processing apparatus (1) includes a punching unit (P), an end-binding unit (S) which aligns end portions of a sheet bundle piled on a processing tray (2) and performs a stapling process, and a middle-binding and middle-folding unit (C) which performs a stapling process on the center of the sheet bundle and then folds centering around the stapling portion to be in a brochure form. The middle-binding and middle-folding unit (C) is independently provided on the lower side of the end-binding unit (S) and a middle-binding and middle-folding feeding path (27) feeds sheets to the middle-binding and middle-folding unit (C) without via the processing tray (2) of the end-binding unit (S).

4 Claims, 7 Drawing Sheets

SHEET POST-PROCESSING APPARATUS

BACKGROUND OF THE INVENTION

This application is based on Japanese Patent Application No. 2004-345149 filed on Nov. 30, 2004.

1. Field of the Invention

The present invention relates to a sheet post-processing apparatus which performs a sheet sorting process, a sheet stapling process, or the like after image forming.

2. Description of the Prior Art

For example, there may be a case where a binding process (hereinafter referred to as a stapling process) and a holing process (hereinafter referred to as a punching process) are desired to be performed on a relatively large volume of sheets of paper bearing an image transferred thereon by an image forming apparatus such as a copying machine or a printer. In such a case, it is convenient to use a sheet post-processing apparatus or a so-called finisher that automatically performs a predetermined post-processing, such as a stapling process and a punching process.

FIG. 7 is a side sectional view showing an example of configuration of a known sheet post-processing apparatus. In FIG. 7, a sheet post-processing apparatus 1 includes a processing tray 2 capable of accommodating a plurality of sheets P and detachably connected, for example, on a sheet discharging side of an image forming apparatus (not shown in the drawing) such as a copying machine. In the case where a stapling process or the like is performed on sheets sequentially discharged from the image forming apparatus, each of the sheets P is once accommodated in the processing tray 2. A pair of introducing rollers 3 is provided on the upper right portion of the processing tray 2, and the sheets P discharged from the image forming apparatus are fed inside the sheet post-processing apparatus 1 via the pair of introducing rollers 3 and introduced on the processing tray 2 through the introducing port 4.

Further, the processing tray 2 is provided with a bundle edge aligning hook 9 movable along the processing tray 2. The bundle edge aligning hook 9 waits at the lower end of the processing tray 2 when the sheets are introduced, and one end of the sheets P, in a feeding direction, that are sequentially introduced onto the processing tray 2 from the pair of introducing rollers 3 is supported by the bundle edge aligning hook 9. In the vicinity of a waiting position of the bundle edge aligning hook 9, an end binding stapler 5 is provided. The end binding stapler 5 performs a stapling process on one set of the sheets P whose end portions in the feeding direction are aligned by the bundle edge aligning hook 9. The sheets P in which the stapling process is completed are fed to the upside of the sheet post-processing apparatus 1 along the processing tray 2 by the bundle edge aligning hook 9 to be discharged to a discharging tray 7 via the bundle discharging rollers 6.

In such a sheet post-processing apparatus, in the case where post-processing such as a stapling process or the like is sequentially performed, processing waiting time occurs because new sheets cannot be introduced to the processing tray 2 during a post-processing operation. Particularly, in the case of sheets of general-purpose A4 size, time intervals between the sheets are minimized so as to be capable of high-speed image forming process. However, post-processing operation has been inefficient due to the processing waiting time in the sheet post-processing apparatus.

Furthermore, in the case where a relationship between the position of the introducing port 4 and the waiting position of the bundle edge aligning hook 9 is not suitable to a feeding direction length of the sheets P, a subsequent sheet could slip in the rear side (on the left side in the drawing) of the sheet previously introduced in the processing tray 2, thereby changing the order of the sheets. Therefore, the introducing port 4 needs to be moved depending on the sheet size; however, this separately requires a driving system for moving the introducing port 4, thereby making the configuration of the device complicated, as well as resulting in increased size and cost of the device.

Consequently, various methods have been proposed to solve the aforementioned problems. Japanese Examined Patent Application No. H06-99070 discloses a sheet processing apparatus in which arrival of a first preceding sheet to sheet processing means is delayed, thereby making the first sheet arrive the processing means in an overlapped state with the subsequent sheet, whereby waiting time can be eliminated as being acceptable for new sheets even when the processing means is during processing operation. Further, Japanese Patent No. 2783326 discloses a post-processing apparatus in which sheets are discharged to a discharging tray on the upper side when a stapling process is not performed; and when a stapling process is performed, a reference side fence of the stapler is moved depending on the sheet size to discharge to a second discharging tray on the lower side by performing the stapling process without moving sheets.

Moreover, Japanese Unexamined Patent Application No. 11-263502 discloses a sheet post-processing apparatus that is provided with different introducing ports for sheets of different sizes to be fed and branching claws corresponding to different lengths of the sheets in the feeding direction, and that prevents the sheets from slipping-in by changing feeding paths by swaying the branching claws so as to feed the sheets to the processing tray from a position corresponding to the size of the sheet.

In the case of so-called middle-binding which performs a stapling process on the middle portion of a bundle of the sheets, it is required to use a separated type stapler in which an ejecting portion of a stapling needle and a receiving portion are separated; and, in the case of a known sheet post-processing apparatus capable of performing end-binding and middle-binding, a separated type stapler for both end-binding and middle-binding is disposed in the central vicinity of the processing tray 2. However, in the case where both the end-binding process and middle-binding process are performed on the processing tray 2, introducing paths for sheets are complicated and easy to generate a jam on the processing tray 2.

Still, generally, the bundle of the sheets performed by middle-binding is simultaneously performed by middle-folding process to be in a brochure form and therefore a middle-folding device is required to be provided adjacent to the processing tray 2; however, it is difficult to secure a sufficient arrangement space. Further, the number of capable of binding of a separated type stapler is less compared to that of an integrated stapler and therefore, in the case where an exclusive color printing paper whose paper surface is hard due to especially surface finishing is used, a stapling process cannot be performed by the number of capable of processing guaranteed in the case of a plain paper and it is difficult to perform both middle-binding and end-binding by the separated type stapler.

According to Japanese Examined Patent Application No. H06-99070 and Japanese Patent No. 2783326, waiting time for accepting sheets and loss of moving time of sheets and a stapler are resolved to accelerate processing, but the aforementioned problems have not been solved. Furthermore, it may be taken into account that the number of capable of processing is increased using a large separated type stapler and an integrated stapler for end-binding is separately provided in addition to a separated type stapler; however, since arrangement space is limited in the vicinity of the processing tray 2, it is difficult to increase the stapler in size and to arrange two staplers. Further, according to Japanese Unexamined Patent Application No. 11-263502, since a plurality of branching claws need to be provided for different sheet sizes and to be switched, there is a problem in that a structure of the feeding paths is complicated.

SUMMARY OF THE INVENTION

In view of the foregoing problems, it is an object of the present invention to provide a sheet post-processing apparatus with a simple structure and high processing efficiency, capable of preventing occurrence of slipping-in of sheets, a jam and the like during the post-processing such as a stapling process.

To attain the aforementioned object, the present invention provides a sheet post-processing apparatus including: a processing tray capable of accommodating a plurality of sheets and disposed in a lengthwise direction; a sheet introducing port that introduces the sheets to the processing tray; a sheet feeding path that guides the sheets to the sheet introducing port; an end-binding unit that performs an end-binding process to a bundle of the sheets whose one ends are aligned at a lower part of the processing tray; a middle-binding and middle-folding unit that performs a middle-binding and middle-folding process of the sheets, and is positioned below the end-binding unit; and a middle-binding and middle-folding feeding path that guides the sheets to the middle-binding and middle-folding unit without going through the processing tray.

According to this configuration, feeding of sheets to the middle-binding and middle-folding unit can be performed without via the processing tray of the end-binding unit and the introducing path of the sheets to the end-binding unit can be simplified and therefore generation of jam or the like on the processing tray can be suppressed. Furthermore, the end binding stapler does not need to also serve as a middle-binding stapler and therefore an integrated stapler with high processing performance can be used as the end binding stapler. Further, an arrangement space for the middle-binding stapler increases and therefore a large separated type stapler can be provided as the middle-binding stapler, the number of sheets to be performed with the end-binding process and the middle-binding and middle-folding process can be increased. Furthermore, the middle-binding stapler is provided in the detachable middle-binding and middle-folding unit, whereby the sheet post-processing apparatus can be reduced in size and cost.

Further, in the aforementioned configured sheet post-process apparatus of the present invention, the sheet introducing port includes a first introducing port introducing sheets not larger than a predetermined size and provided at a lower part of the processing tray, and a second introducing port introducing sheets larger than the predetermined size and provided at an upper part of the processing tray.

According to this configuration, the first introducing port for introducing sheets not larger than the predetermined size is provided at the lower part of the processing tray and a second introducing port for introducing sheets larger than a predetermined size provided at the upper part of the processing tray, whereby large size sheets can be piled from top of the processing tray and small size sheets can be piled from lower part of the processing tray along the tray surface in a good order and therefore there is no possibility that subsequent sheets are slipped in under the previously piled sheets.

Furthermore, in the aforementioned configured sheet post-process apparatus of the present invention, the sheet feeding path guides the sheets to the first introducing port, and includes a main feeding path and a branched feeding path branched from the main feeding path in a bypass state, and when a plurality of bundles of the sheets of the predetermined size are continuously processed on the processing tray, the sheet feeding path has a first sheet of each bundle subsequent to a first bundle wait in the main feeding path, and guides a second sheet of the each bundle using the branched feeding path, thereby piling the first and second sheets of the each bundle on the processing tray simultaneously through the first introducing port.

According to this configuration, the sheet feeding path before the first introducing port is branched into the main feeding path and the branched feeding path, and, when a plurality of bundles of the sheets of the predetermined size are continuously processed on the processing tray, a first sheet of each bundle subsequent to a first bundle is kept waiting in the main feeding path and then piled onto the processing tray simultaneously with a second sheet of the each bundle that is introduced via the branched feeding path. By this, process of the previous bundle of the sheets is completed during waiting of the first sheet and therefore processing waiting time in the case of continuous processing can be eliminated, and post-processing efficiency of an A4 size sheet especially required for speed up can be enhanced.

Further, in the aforementioned configured sheet post-process apparatus of the present invention, the middle-binding and middle-folding feeding path extends from a mid-flow of the branched feeding path.

According to this configuration, a middle-binding and middle-folding feeding path extends from the mid-flow of the branched feeding path, a part of the branched feeding path can be served as the sheet feeding path to the middle-binding and middle-folding unit and therefore it can be contributed to simplification of the feeding path and size reduction of the sheet post-processing apparatus.

DESCRIPTION OF THE PREFERRED EMBODIMENTS

Figure 1:
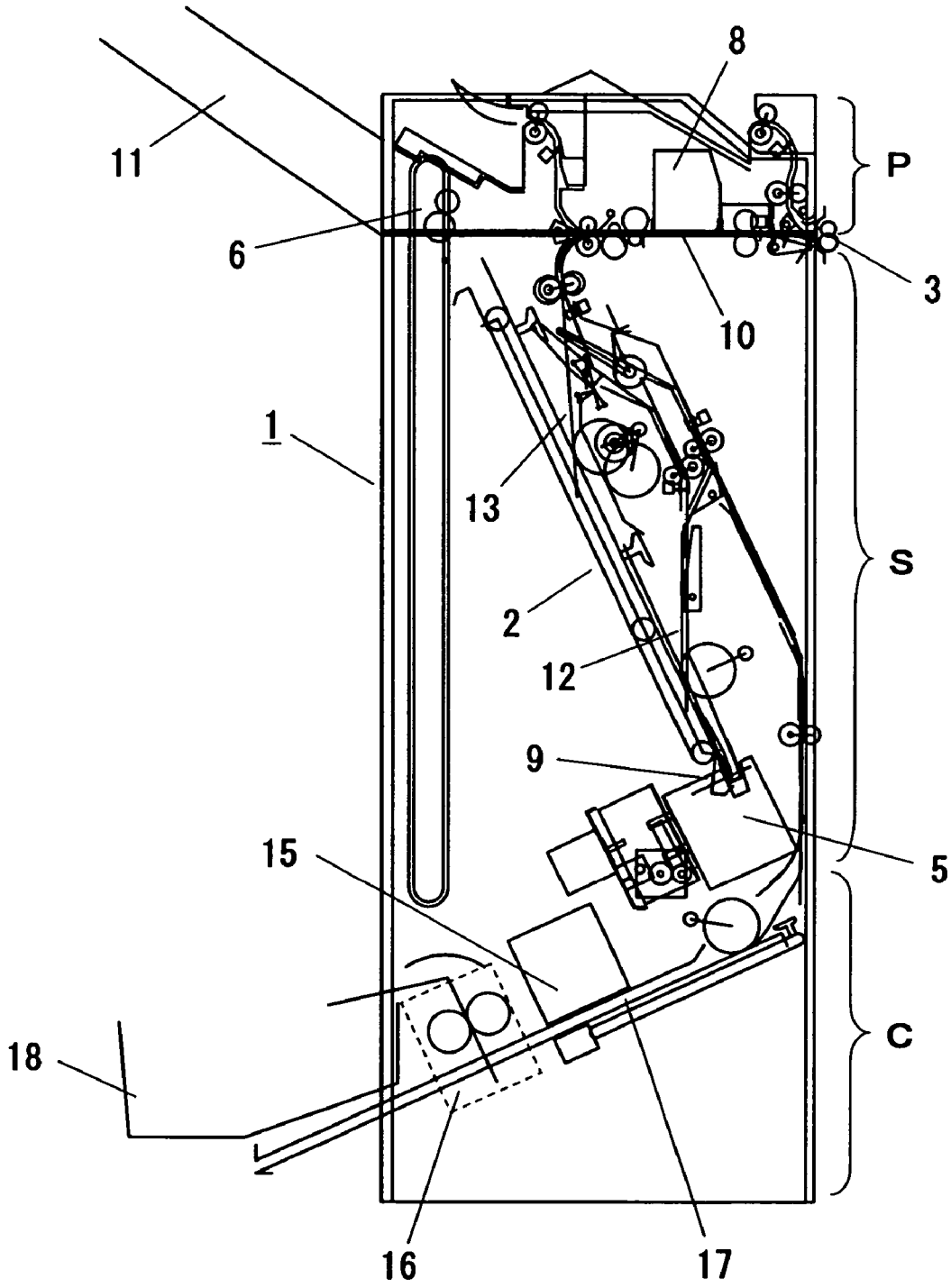
FIG. 1 is a side sectional view showing an entire configuration of a sheet post-processing apparatus according to the present invention.

An embodiment of the present invention will be described below with reference to the drawings. FIG. 1 is a side sectional view showing configuration of a sheet post-processing apparatus according to the present invention. The sheet post-processing apparatus of the present invention includes a middle-binding and middle-folding unit which performs middle-binding and middle-folding of sheets in addition to an end-binding unit, and sheet feeding to the middle-binding and middle-folding unit is performed without via a processing tray.

In FIG. 1, a sheet post-processing apparatus 1 includes a punching unit P which forms a punch hole on a sheet, an end-binding unit S which aligns end portions of a bundle of sheets piled on a processing tray 2 and performs a stapling process, and a middle-binding and middle-folding unit C which performs the stapling process on the center of the sheet bundle and then folds centering around the stapling portion to be in a brochure form.

The punching unit P is placed at the top of the sheet post-processing apparatus 1, and sheets image formed at an image forming apparatus (not shown in the drawing) are fed via a pair of introducing rollers 3 provided on the upper right of the sheet post-processing apparatus 1 to proceed toward the left direction in a sheet feeding path 10. After the sheets pass through a punch hole forming device 8, the sheets are directly discharged to a main tray 11 when the stapling process is not performed. When the stapling process is performed, the sheets are fed to the end-binding unit S or the middle-binding and middle-folding unit C arranged on the lower side of the punching unit P.

The end-binding unit S arranged below the punching unit P is constituted by the processing tray 2, a first and a second introducing ports 12 and 13 for introducing sheets to the processing tray 2, an end binding stapler 5, and the like. Sheets not larger than a predetermined size (here, A4 size) are piled on the processing tray 2 from the first introducing port 12; and, sheets larger than a predetermined size are piled on the processing tray 2 from the second introducing port 13. A sheet bundle piled on the processing tray 2 is aligned by a bundle edge aligning hook 9, and is moved to the end binding stapler 5 to be stapled at the lower end thereof; then, the sheet bundle moves upward along the processing tray 2 again to be discharged to the main tray 11 via bundle discharging rollers 6.

The middle-binding and middle-folding unit C arranged below the end-binding unit S is constituted by a middle-binding stapler 15, a middle-folding device 16, a sheet guide 17, and the like. The middle-binding stapler 15 performs the stapling process on the center portion of the sheet bundle piled in the sheet guide 17. The sheet bundle performed by the stapling process with the middle-binding stapler 15 is folded with the middle-folding device 16 centering on the stapling portion to be in a brochure form and then discharged to a brochure tray 18.

Figure 2:
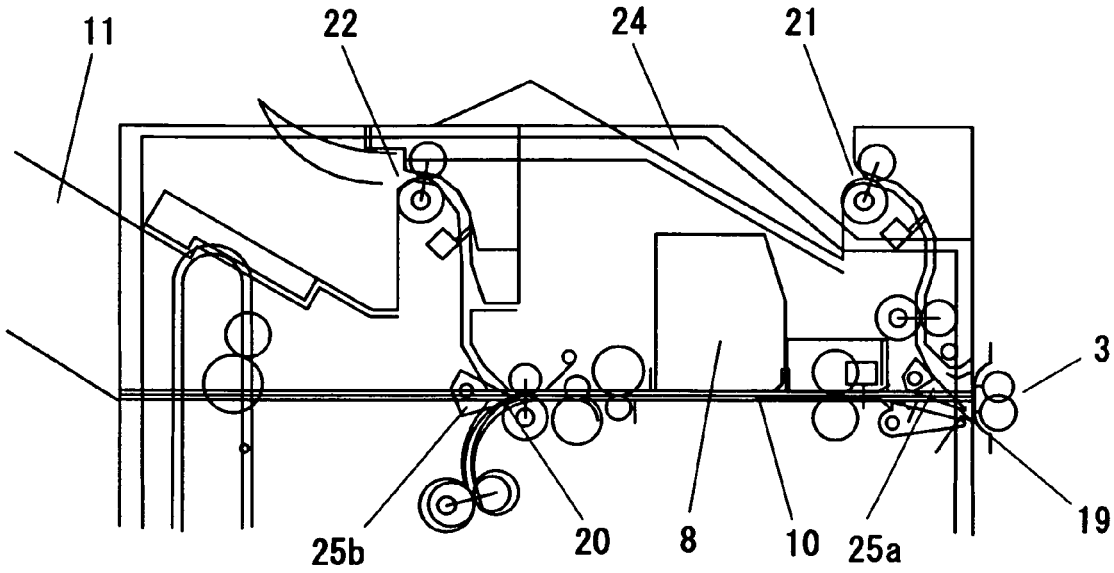
FIG. 2 is a relevant part cross-sectional view showing the vicinity of a punching unit of the sheet post-processing apparatus according to the present invention.
Figure 3:
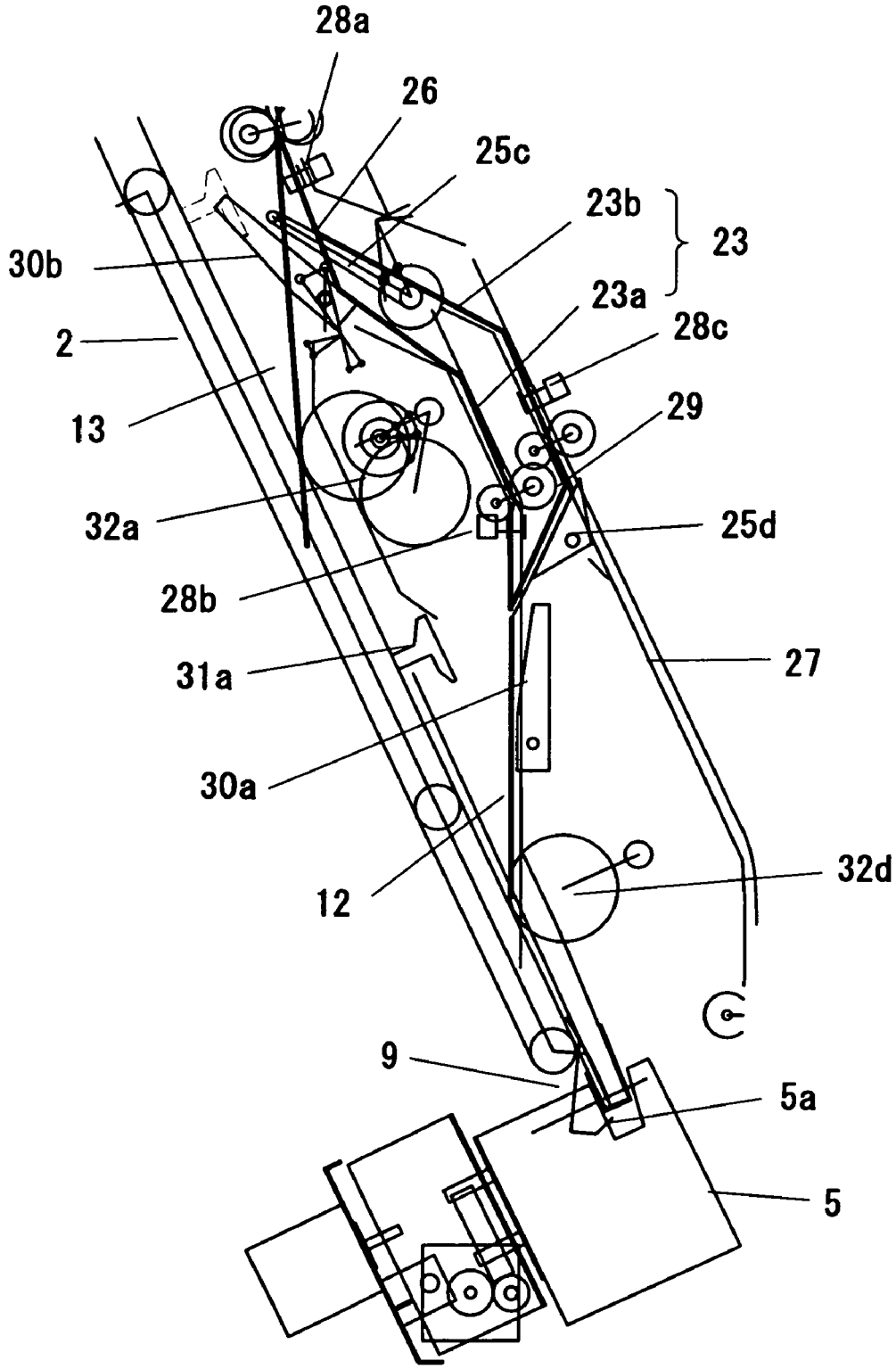
FIG. 3 is a relevant part cross-sectional view showing the vicinity of an end-binding unit of the sheet post-processing apparatus according to the present invention.
Figure 4:
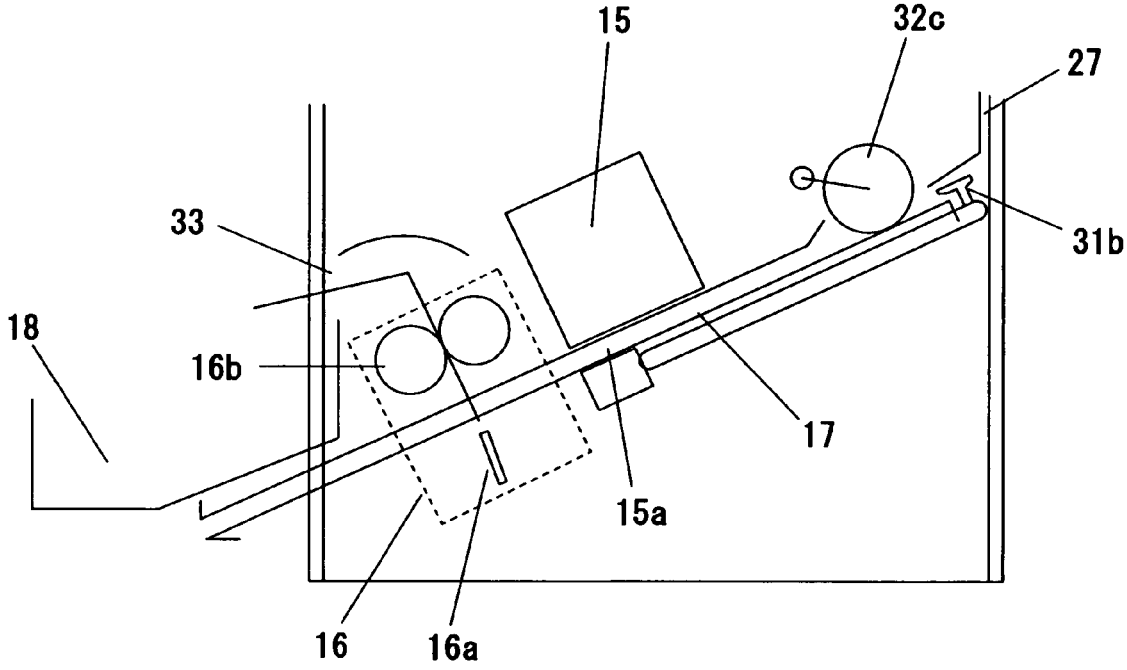
FIG. 4 is a relevant part cross-sectional view showing the vicinity of a middle-binding and middle-folding unit of the sheet post-processing apparatus according to the present invention.

FIG. 2 is an enlarged view around the punching unit P shown in FIG. 1; FIG. 3 is an enlarged view around the end-binding unit S; and FIG. 4 is an enlarged view around the middle-binding and middle-folding unit C. The same reference numerals are given to those common to parts shown in FIG. 1. Referring to FIG. 2 to FIG. 4, each structure of the sheet post-processing apparatus 1 will be described in detail.

The punching unit P, as shown in FIG. 2, is constituted by a punch hole forming device 8, a first branched portion 19, a second branched portion 20, a first discharging roller 21, second discharging rollers 22, and the like. In the case where both a punch hole forming process and the stapling process are not performed, path switching means 25*a* provided at the first branched portion 19 blocks a path of a proceeding direction by a signal from a control unit of an image forming apparatus not shown in the drawing; and therefore, the sheets introduced into the punching unit P from the pair of introducing rollers 3 proceed in an upward direction at the first branched portion 19 and are discharged outside the device from the first discharging roller 21 to be piled on a sheet tray 24 provided on the upper surface of the device.

In the case where the punch hole forming process or the stapling process is performed, the path switching means 25*a* blocks the path in the upward direction; and therefore, the sheets directly proceed at the first branched portion 19 and are fed to the punch hole forming device 8. When a punch hole forming is designated, a punch hole is formed at a predetermined position of the sheet; and when the punch hole forming is not designated, the sheet directly passes through the punch hole forming device 8 and are fed to the second branched portion 20.

In the case where only the punch hole forming process is performed and the stapling process is not performed, path switching means 25*b* provided at the second branched portion 20 blocks a path of a downward direction; and therefore, the sheets proceed in an upward direction at the second branched portion 20 and are discharged outside the device from the second discharging rollers 22 to be piled on the main tray 11. On the other hand, in the case where the stapling process is performed, the path switching means 25*b* blocks a path of upward direction; and therefore, the sheets proceed in a downward direction at the second branched portion 20 and are fed to an end-binding unit S or a middle-binding and middle-folding unit C to be described later.

In the case where an end portion of the sheet bundle is performed by the stapling process, after the sheets proceed toward a downward direction in the second branched portion 20, the sheets are fed to the end-binding unit S shown in FIG. 3. In the case of sheets not larger than the predetermined size (A4 size), the sheets are piled on the processing tray 2 via a sheet feeding path 23 and the first introducing port 12. On the other hand, in the case where the sheets are larger than a predetermined size, the sheets are piled on the processing tray 2 via the second introducing port 13.

The sheet feeding path 23 is constituted by a main feeding path 23*a* and a branched feeding path 23*b* which is branched in a bypass state from the main feeding path 23*a* and joins together with the main feeding path 23*a* again before a first introducing port 9. In the case where a plurality sets of sheet bundles having a predetermined size (A4 size) are continuously performed on the processing tray 2, the branched feeding path 23*b* is used to simultaneously pile a second sheet with a first sheet on the processing tray 2 in order not to generate processing waiting time at the process of a second set or later. Furthermore, a middle-binding and middle-folding feeding path 27 which feeds the sheets to the middle-binding and middle-folding unit C extends from the mid-flow of the branched feeding path 23*b*.

Path switching means 25*c* is provided at a third branched portion 26 in which the main feeding path 23*a* and the branched feeding path 23*b* are branched, and switches the main feeding path 23*a* and the branched feeding path 23*b* in the case where a plurality of sheet bundles each having a predetermined size are processed or the sheets are fed to the middle-binding and middle-folding unit C via the middle-binding and middle-folding feeding path 27. FIG. 3 shows a state where the feeding path is switched to the branched feeding path 23*b*.

Path switching means 25*d* is provided at a fourth branched portion 29 in which the branched feeding path 23*b* and the middle-binding and middle-folding feeding path 27 are branched, and switches between the branched feeding path 23*b* and the middle-binding and middle-folding feeding path 27 in the case where the sheets are fed to the middle-binding and middle-folding unit C. FIG. 3 shows a state where the feeding path is switched to the branched feeding path 23*b*. Furthermore, detecting sensors 28*a*, 28*b*, and 28*c* are arranged on an upper stream side of the third branched portion 26, the main feeding path 23*a*, and the branched feeding path 23*b*, respectively.

30*a* and 30*b* denote tapping members which tap the sheets introduced from the first introducing port 12 and the second introducing port 13 toward a direction of the processing tray 2 to align to the tray surface, and are pivotably provided each adjacent to the first introducing port 12 and the second introducing port 13. Furthermore, the tapping member 30*b* also serves as path switching means which switches between the feeding path to the second introducing port 13 and the sheet feeding path 23 depending on the sheet size to be introduced to the processing tray 2; and FIG. 3 shows a state where the tapping member 30*b* blocks the second introducing port 13 and the feeding path is switched to the sheet feeding path 23. A T-shaped member 31*a* is provided on the processing tray 2 to maintain an upper portion of the sheets piled along the processing tray 2 so as not to be floated and moves on the processing tray 2 depending on the sheet size. 32*a* and 32*b* denote pressing rollers which press the sheets piled on the processing tray 2 along the tray surface.

In order to prevent from generating of inadequate order due to slipping of the sheets to be introduced to the processing tray 2, the bundle edge aligning hook 9 moves along the processing tray 2 depending on the sheet size and aligns a lower portion of the sheet bundle to be piled on the processing tray 2. When a predetermined number of the sheets are piled, the bundle edge aligning hook 9 lowers down to the end binding stapler 5 and the lower end of the aligned sheet bundle is inserted into a stapling portion 5*a*. After an end-binding process of the sheet bundle is performed at the stapling portion 5*a*, the bundle edge aligning hook 9 goes up again along the processing tray 2 and the sheet bundle is discharged on the main tray 11 from the bundle discharging rollers 6 (for these two, see FIG. 1).

In the case where the sheet bundle is performed by a middle-binding and middle-folding process to be in a brochure form, the sheets proceed to downward direction in the branched feeding path 23*b* and the middle-binding and middle-folding feeding path 27 and are fed to the middle-binding and middle-folding unit C shown in FIG. 4. The fed sheets are piled by a predetermined numbers within the sheet guide 17 with the image surface faced downward so that the center of the sheet is placed at a stapling portion 15*a* of the middle-binding stapler 15 and then performed by the middle-binding process. The sheet guide 17 includes a T-shaped member 31*b* which moves along the sheet guide 17 and prevents uplift of a back-end of the sheet and a pressing roller 32*c* which presses the back-end of the sheet introduced to the sheet guide 17, along the guide surface.

The sheet bundle performed by the middle-binding process is fed to the middle-folding device 16 disposed at the lower stream side of the middle-binding stapler 15. The middle-folding device 16 includes a thrusting plate 16*a* and a pair of pressing rollers 16*b*, which stand face to face sandwiching the sheet guide 17. The middle-folding process is performed by a method in which a middle-binding portion at the center of the sheet bundle is thrusted by the thrusting plate 16*a* to be folded in an angle-shaped and the pair of pressing rollers 16*b* are further passed from the folded portion. The brochure formed sheet bundle passed through the middle-folding device 16 is discharged to the brochure tray 18 from a brochure discharging port 33.

The present invention is characterized in that the middle-binding and middle-folding unit C is independently provided on the lower side of the end-binding unit S and feeding of the sheets to the middle-binding and middle-folding unit C is performed without via the processing tray 2 of the end-binding unit S. This configuration simplifies the introducing path to the end-binding unit S and therefore generation of jam or the like on the processing tray 2 can be suppressed.

Furthermore, the end-binding stapler does not need to be served as the middle-binding stapler and therefore an integrated stapler with high processing performance can be used as the end binding stapler 5 and the number of sheets capable of performing the end-binding process can be increased. Further, the middle-binding stapler 15 is not arranged in the processing tray 2 and therefore arrangement space of the middle-binding stapler can be increased and a large separated type stapler can be used as the middle-binding stapler 15 and the number of sheets capable of performing the middle-binding and middle-folding process can be also increased. Still, the middle-binding and middle-folding feeding path 27 which feeds the sheets to the middle-binding and middle-folding unit C is extendingly provided from the branched feeding path 23*b*, whereby a part of the branched feeding path 23*b* can be served as the sheet feeding path to the middle-binding and middle-folding unit C and this can also contribute to simplification of the feeding path and size reduction of the sheet post-processing apparatus.

Furthermore, sheets not larger than the predetermined size (A4 size) are introduced from the lower part of the processing tray 2 through the first introducing port 12 and sheets larger than a predetermined size are introduced from the top of the processing tray 2 through the second introducing port 13 on the processing tray 2; further, the bundle edge aligning hook 9 and the T-shaped member 31*a* move depending on the sheet size, whereby the sheets can be piled in good order along the tray surface irrespective of the sheet size and there is no possibility that the subsequent sheet slips in under the previously piled sheet.

In addition, here, two introducing ports, that is, the first introducing port 12 and the second introducing port 13*a* are provided as the sheet introducing port to the processing tray 2; however, not less than three introducing ports may be provided or one movable sheet introducing port which moves depending on the sheet size may be provided depending on the sheet size. But, if the sheet introducing port is movable configuration, a driving mechanism is separately required and therefore it is preferable to provide at least two sheet introducing ports as in this embodiment.

Furthermore, since the sheet feeding path 23 located before the first introducing port 12 is branched into the main feeding path 23*a* and the branched feeding path 23*b*, in the case where a plurality sets of sheets having a predetermined size are continuously performed by the end-binding process, while a first sheet of a second set or later is made to wait within the main feeding path 23*a*, piling to the processing tray 2 can be made simultaneously with a second sheet introduced via the branched feeding path 23*b*. Process of the previous sheet bundle is completed during waiting of the first sheet to discharge from the processing tray 2 to the main tray 11 and therefore processing waiting time can be eliminated and post-processing efficiency of an A4 size sheet especially required for speed up can be enhanced.

In addition, in the aforementioned configuration, the middle-binding and middle-folding unit C is incorporated within the sheet post-processing apparatus 1; however, the middle-binding and middle-folding unit C can be detachable to the device body as a separate unit by configuration of the present invention in which the middle-binding and middle-folding unit C is independently provided on the lower side of the end-binding unit S. In such a case, a user who does not perform the middle-binding and middle-folding process may use the sheet post-processing apparatus 1 without mounting the middle-binding and middle-folding unit C. This contributes to reduction in weight, size, and cost of the device.

Figure 5:
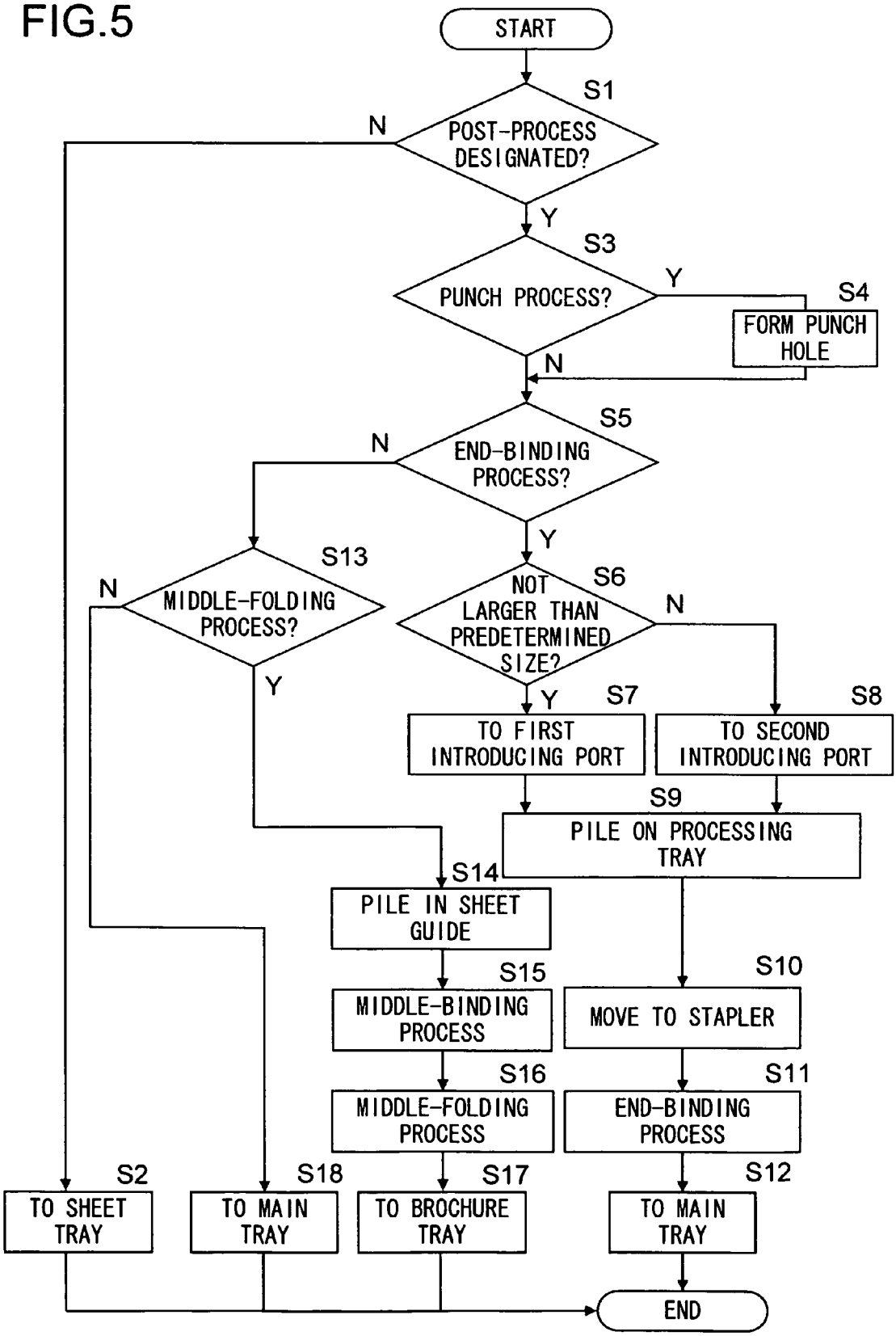
FIG. 5 is a flow chart showing post-processing operation procedure of the sheet post-processing apparatus according to the present invention.

FIG. 5 is a flow chart showing post-processing procedure in the sheet post-processing apparatus of the present invention. Post-processing operation of the sheet post-processing apparatus will be described according to steps shown in FIG. 5 with reference to FIG. 1 to FIG. 4. When an image forming process is completed, it is first judged whether or not a post-process is designated by a user in the control unit of the image forming apparatus (step S1); and in the case of not performing post-processing, the process is completed by directly discharging on the sheet tray 24 by first discharging rollers 22 (step S2).

When any post-processing is designated in step S1, it is then judged whether or not the punch hole forming process is designated (step S3). When the punch hole forming is designated, a punch hole is formed in passing through the punch hole forming device 8 (step S4); and in the case of not being designated, the process directly passes through the punch hole forming device 8 to proceed the next step.

Next, it is judged whether or not the end-binding process of sheets is designated (step S5). When the end-binding is designated, it is judged whether or not sheet size is not larger than the predetermined size (step S6). When the sheet size is not larger than the predetermined size, the sheets are introduced to the first introducing port 12 via the sheet feeding path 23 (step S7); and, when the sheet size is not less than a predetermined size, the sheets are introduced to the second introducing port 13 (step S8). At the same time, the bundle edge aligning hook 9 and the T-shaped member 31*a* move on the processing tray 2 according to the sheet size.

After that, the sheets are piled in introducing order on the processing tray 2 by the first introducing port 12 or the second introducing port 13 (step S9). After predetermined number sheets are piled, the bundle edge aligning hook 9 moves downward and the lower end of the sheet bundle is moved to the stapling portion 5*a* of the end binding stapler 5 (step S10) to perform an end-binding process (step S11). The sheet bundle performed by end-binding is moved again upward along the processing tray 2 and then discharged on the main tray 11 by the bundle discharging rollers 6 (step S12) to complete the process.

On the other hand, when the end-binding process is not designated in step S5, it is judged whether or not the middle-binding and middle-folding process is designated (step S13). When the middle-binding and middle-folding process is designated, the sheets are piled in introducing order in the sheet guide 17 passing through the branched feeding path 23*b* and the middle-binding and middle-folding feeding path 27 (step S14). After predetermined number sheets are piled, the center of the sheet bundle is positioned to a stapling portion 15*a* of the middle-binding stapler 15 to be performed by the middle-binding process (step S15).

The sheet bundle performed by middle-binding has a middle-binding portion which is positioned to the thrusting plate 16*a* of the middle-folding device 16 and then thrusted by the thrusting plate 16*a* to be half folded; and the pressing roller 16*b* are passed from the folded portion to perform the middle-folding process (step S16). The sheet bundle performed by the middle-folding process to be in a brochure form is discharged to the brochure tray 18 from the brochure discharging port 33 (step S17) to complete the process.

In the case where the middle-binding and middle-folding process is not designated in step S13, since only the punch hole forming process is designated, the sheets are performed by punch hole forming by the punch hole forming device 8 and then discharged to the main tray 11 via the second discharging rollers 22 (step S18) to complete the process.

Figure 6:
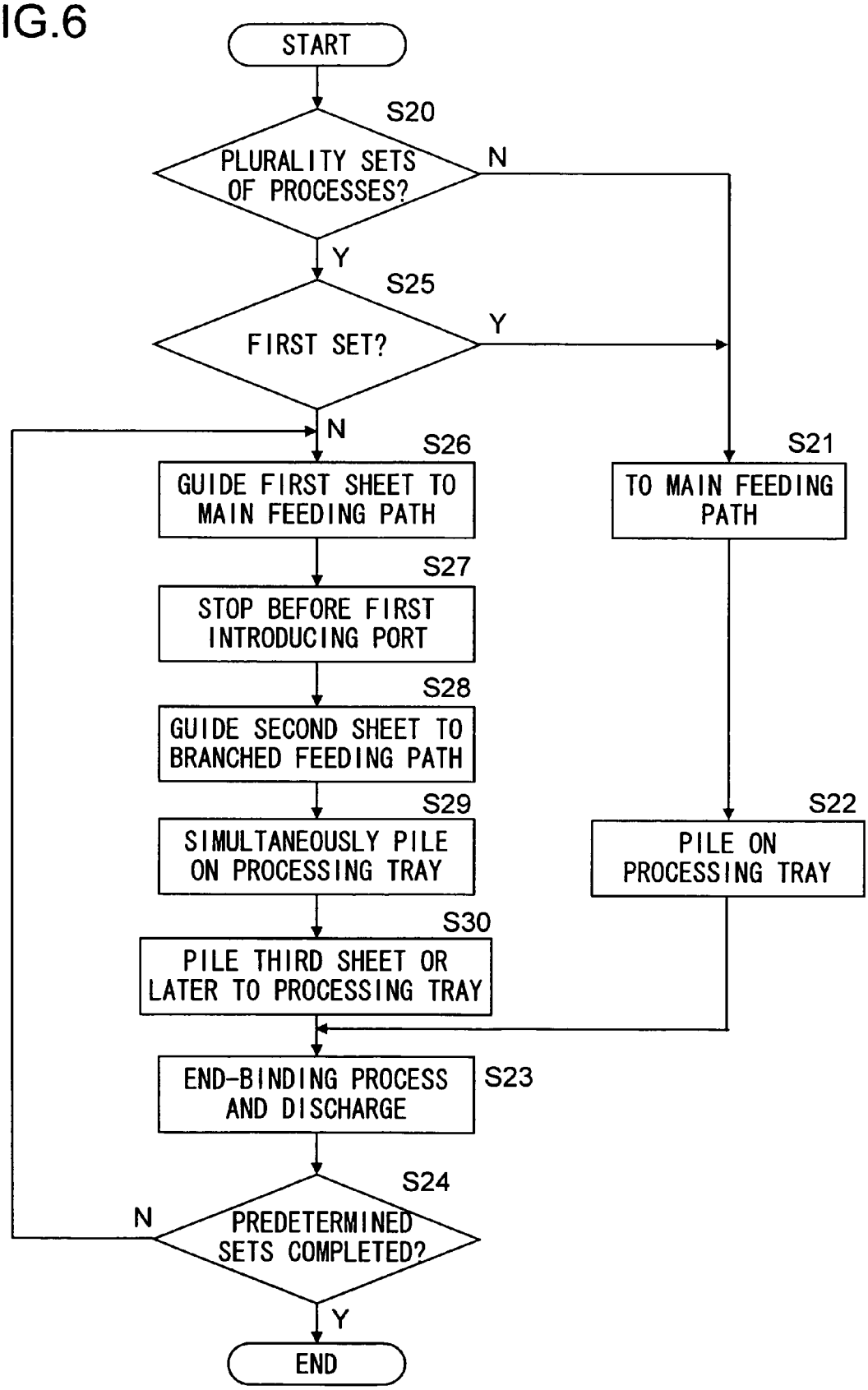
FIG. 6 is a flow chart showing control procedure in the case where a bundle of the sheets of a predetermined size (A4 size) is continuously performed by an end-binding process.
Figure 7:
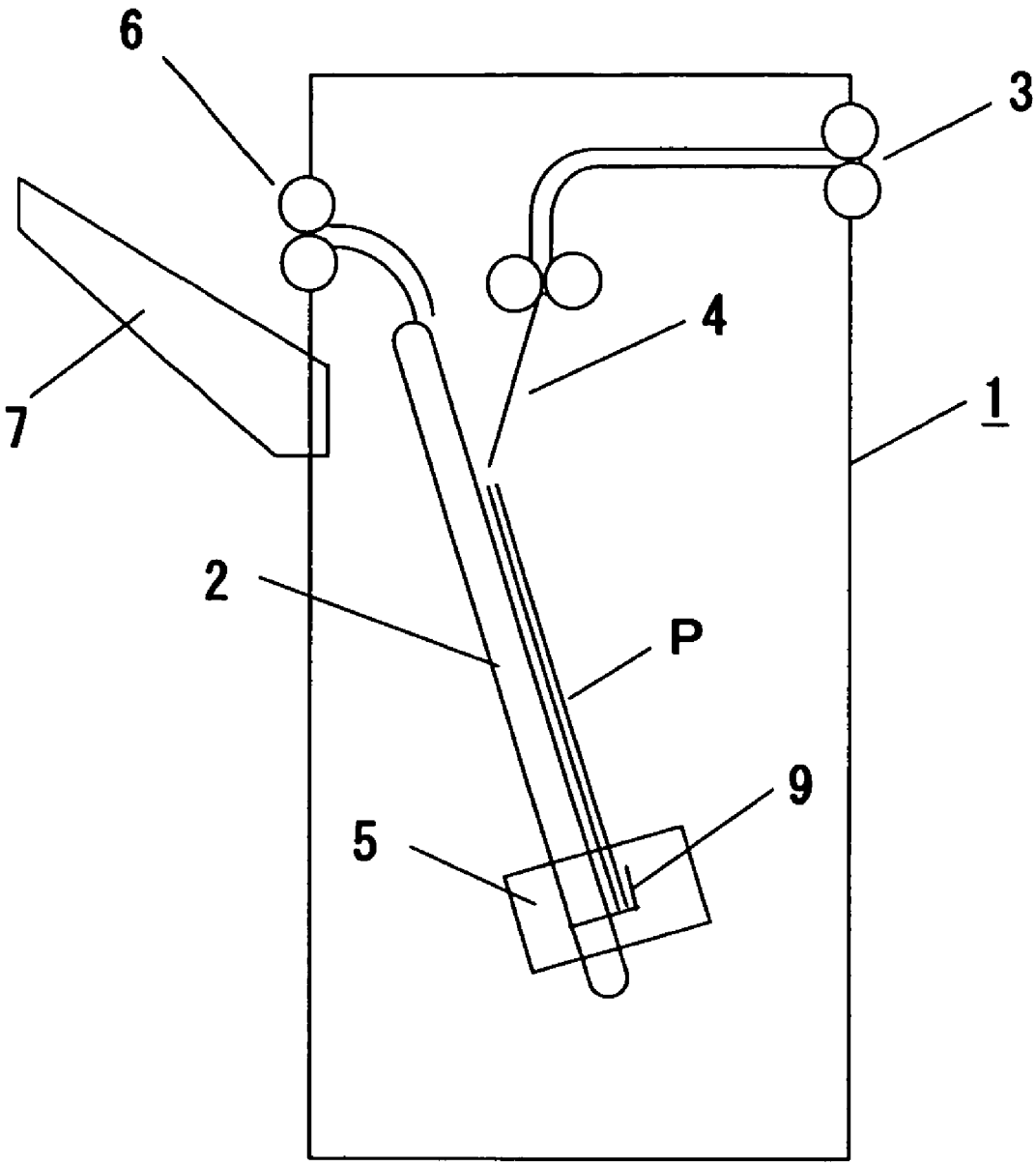
FIG. 7 is a side sectional view showing an entire configuration of a known sheet post-processing apparatus.

FIG. 6 is a flow chart showing control procedure when the sheet bundle having a predetermined size (A4 size) is continuously performed by the end-binding process in the sheet post-processing apparatus of the present invention. Operation of the sheet post-processing apparatus will be described according to steps shown in FIG. 6 with reference to FIG. 3 to FIG. 5. When it is judged as the end-binding process of a predetermined size in step S6 shown in FIG. 5, it is judged whether or not a plurality sets of end-binding processes are designated (step S20).

When only one set of the end-binding process is designated, the sheet is guided to the first introducing port 12 from the main feeding path 23*a* (step S21) and sequentially piled on the processing tray 2 (step S22). After that, as in steps S10 to S12 shown in FIG. 5, the lower end of the sheet bundle moves to the stapling portion 5*a* of the end binding stapler 5 to perform the end-binding process; and the sheet bundle performed by the end-binding moves upward again along the processing tray 2 and then discharged on the main tray 11 by the bundle discharging rollers 6 (step S23). After that, it is judged whether or not a predetermined set (one set, in this case) of processes is completed (step S24) to complete the process.

When the end-binding process is a plurality sets in step S20, then it is judged whether or not the process is a first set (step S25). In the case of the first set, as in the case that the end-binding process is only one set, the sheets are guided to the first introducing port 12 from the main feeding path 23*a* (step S21) and sequentially piled on the processing tray 2 (step S22). After that, the sheets are moved to the end binding stapler 5 to be performed by the end-binding process and discharged on the main tray 11 by the bundle discharging rollers 6 (step S23).

When the process is a second set or later in step S25, the first sheet is guided to the main feeding path 23*a* (step S26) and stopped before the first introducing port 12 (step S27). Then, a second sheet is guided to the branched feeding path 23*b* (step S28). Since the previous end-binding process is completed during waiting of the first sheet, the second sheet is piled on the processing tray 2 from the first introducing port 12 simultaneously with the first sheet which is made to wait (step S29).

Sheets of a third sheet or later are guided to the main feeding path 23*a* as in the first sheet, and sequentially piled on the processing tray 2 from the first introducing port 12 (step S30). After that, as in the case of the first set, the end-binding process and discharge to the main tray 11 are performed (step S23). Then, it is judged whether or not a predetermined set of processes are completed (step S24); and when the process is going on, the process returns to step S26 to repeat piling of the sheets (steps S26 to 30), end-binding and discharging operation (step S23) as in the above-mention. In a predetermined size, a plurality sets of sheets can be continuously processed on the processing tray 2 without waiting time.

In addition, the present invention is not limited to the aforementioned embodiments, and various modifications may be implemented without departing from the scope of the invention. For example, although the aforementioned embodiments are configured to have three discharging trays of the main tray 11, brochure tray 18, and sheet tray 24 and to discharge sheets or sheet bundles by branching to the respective discharge trays according to kinds of post-processing, a sheet bundle performed by the end-binding process and a brochure performed by the middle-binding and middle-folding process may be discharged to the same discharging tray.

According to the present invention, feeding of sheets to the middle-binding and middle-folding unit is performed without via the processing tray of the end-binding unit and therefore the introducing path of the sheets to the end-binding unit can be simplified and generation of jam or the like on the processing tray can be suppressed. Furthermore, since the middle-binding and middle-folding unit is independent from the end-binding unit, the end-binding stapler does not need to be served as the middle-binding stapler and therefore an integrated stapler with high processing performance for end-binding can be arranged. On the other hand, a large separated type stapler for middle-binding can be arranged and therefore the number of sheets capable of performing the middle-binding process can be increased. Further, the middle-binding and middle-folding unit can be detachably configured and this can contribute to reduction in weight, size, and cost of the sheet post-processing apparatus.

Further, the first introducing port for introducing a sheet not larger than the predetermined size and the second introducing port for introducing a sheet larger than a predetermined size are provided, the large size sheet can be piled from the top of the processing tray and the small size sheet can be piled from the lower part of the processing tray in good order along the tray surface, and therefore generation of staple defects due to slip-in of the sheets can be prevented.

Moreover, the sheet feeding path before the first introducing port is branched into the main feeding path and the branched feeding path, and, when a plurality of bundles of the sheets of the predetermined size are continuously processed on the processing tray, a first sheet of each bundle subsequent to a first bundle is kept waiting in the main feeding path and then piled onto the processing tray simultaneously with a second sheet of the each bundle that is introduced via the branched feeding path. By this, process of the previous bundle of the sheets is completed during waiting of the first sheet and therefore processing waiting time in the case of continuous processing can be eliminated, and especially, post-processing in response to image forming speed by high speed machine can be performed by enhancing post-processing efficiency of an A4 size sheet.

In addition, by providing the middle-binding and middle-folding feeding path so as to extend from the mid-flow of the branched feeding path, and thus making a part of the branched feeding path be also served as the middle-binding and middle-folding feeding path, it is possible to simplify the feeding path and to reduce the size of the sheet post-processing apparatus in comparison with the case where the middle-binding and middle-folding feeding path is provided independently.

What is claimed is:

1. A sheet post-processing apparatus, comprising:

a processing tray capable of accommodating a plurality of sheets and disposed in a lengthwise direction;

a sheet introducing port that introduces the sheets to the processing tray;

a sheet feeding path that guides the sheets to the sheet introducing port;

an end-binding unit that performs an end-binding process to a bundle of the sheets whose one ends are aligned at a lower part of the processing tray;

a middle-binding and middle-folding unit that performs middle-binding and middle-folding process of the sheets, and is positioned below the end-binding unit; and a middle-binding and middle-folding feeding path that extends, starting at a middle of the sheet feeding path, substantially parallel along the processing tray in opposition to a substantial portion of the processing tray such that the processing tray and the middle-binding and middle-folding feeding path overlap in a direction perpendicular to the plane of the processing tray, the middle-binding and middle-folding feeding path guiding the sheets to the middle-binding and middle-folding unit without going through the processing tray.

2. The sheet post-processing apparatus according to claim 1, wherein the sheet introducing port includes a first introducing port introducing sheets not larger than a predetermined size and provided at a lower part of the processing tray, and a second introducing port introducing sheets larger than the predetermined size and provided at an upper part of the processing tray.

3. The sheet post-processing apparatus according to claim 2, wherein the sheet feeding path which guides the sheets to the first introducing port includes a main feeding path and a branched feeding path branched from the main feeding path so as to form a bypass, and when a plurality of bundles of sheets of the predetermined size are continuously processed on the processing tray, the sheet feeding path has a first sheet of each bundle subsequent to a first bundle wait in the main feeding path, and guides a second sheet of each bundle using the branched feeding path, thereby piling the first and second sheets of each bundle on the processing tray simultaneously through the first introducing port.

4. The sheet post-processing apparatus according to claim 3, the middle-binding and middle-folding feeding path extends from a mid-flow of the branched feeding path.

* * * * *